US007168640B2

(12) United States Patent
Lipowski

(10) Patent No.: US 7,168,640 B2
(45) Date of Patent: Jan. 30, 2007

(54) METHOD AND APPARATUS FOR COMMINUTING WASTE

(75) Inventor: Wolfgang Lipowski, Seck (DE)

(73) Assignee: Vecoplan Maschinenfabrik GmbH & Co. KG, Bad Marienberg (DE)

( * ) Notice: Subject to any disclaimer, the term of this patent is extended or adjusted under 35 U.S.C. 154(b) by 185 days.

(21) Appl. No.: 10/898,708

(22) Filed: Jul. 23, 2004

(65) Prior Publication Data

US 2005/0061897 A1 Mar. 24, 2005

(30) Foreign Application Priority Data

Jul. 23, 2003 (DE) ..... 103 33 359

(51) Int. Cl.
*B02C 9/04* (2006.01)

(52) U.S. Cl. ..... 241/36; 241/282

(58) Field of Classification Search ..... 241/101.2, 241/282, 30, 36

See application file for complete search history.

(56) References Cited

U.S. PATENT DOCUMENTS

| | | | | |
|---|---|---|---|---|
| 3,868,062 A * | 2/1975 | Cunningham et al. | ..... | 241/36 |
| 4,452,400 A * | 6/1984 | Williams | ..... | 241/36 |
| 4,793,561 A * | 12/1988 | Burda | ..... | 241/36 |
| 5,730,373 A * | 3/1998 | Tamura et al. | ..... | 241/34 |

FOREIGN PATENT DOCUMENTS

| | | |
|---|---|---|
| DE | 3920273 | 1/1911 |
| DE | 2518938 | 11/1975 |
| DE | 2926975 | 12/1980 |
| DE | 2937846 | 3/1981 |
| DE | 3029030 | 2/1982 |
| DE | 3112913 | 10/1982 |
| DE | 3412306 | 10/1985 |
| DE | 3704713 | 7/1988 |
| DE | 3819285 | 12/1989 |
| DE | 4207292 | 1/1993 |
| DE | 4406675 | 9/1994 |
| DE | 4342647 | 6/1995 |
| DE | 19523842 | 1/1997 |
| DE | 19641975 | 4/1998 |
| DE | 19835093 | 2/1999 |
| DE | 19745134 | 4/1999 |
| DE | 19902227 | 7/2000 |
| DE | 10029959 | 10/2001 |
| DE | 10028191 | 12/2001 |
| DE | 20120163 | 3/2002 |
| DE | 10240048 | 3/2004 |
| EP | 0274749 | 7/1988 |
| EP | 0281136 | 9/1988 |

* cited by examiner

*Primary Examiner*—Faye Francis
(74) *Attorney, Agent, or Firm*—Alston & Bird LLP

(57) ABSTRACT

In a method and apparatus for comminuting waste to minimise the risk of damage to the apparatus and to provide quick flexible reaction to changing operating conditions the comminuting apparatus includes a drive unit having at least one electric motor in the form of a between 12-pole and 32-pole three-phase synchronous motor operating at a rotary speed of between 1 and 500 rpm. The motor is electrically connected to the output of a frequency converter controlled by a control device. The drive shaft of the motor is connected without interposed transmission directly to the comminuting shaft and no torque- and/or force-transmitting drive element rotates more quickly than the drive shaft of the motor.

19 Claims, 1 Drawing Sheet

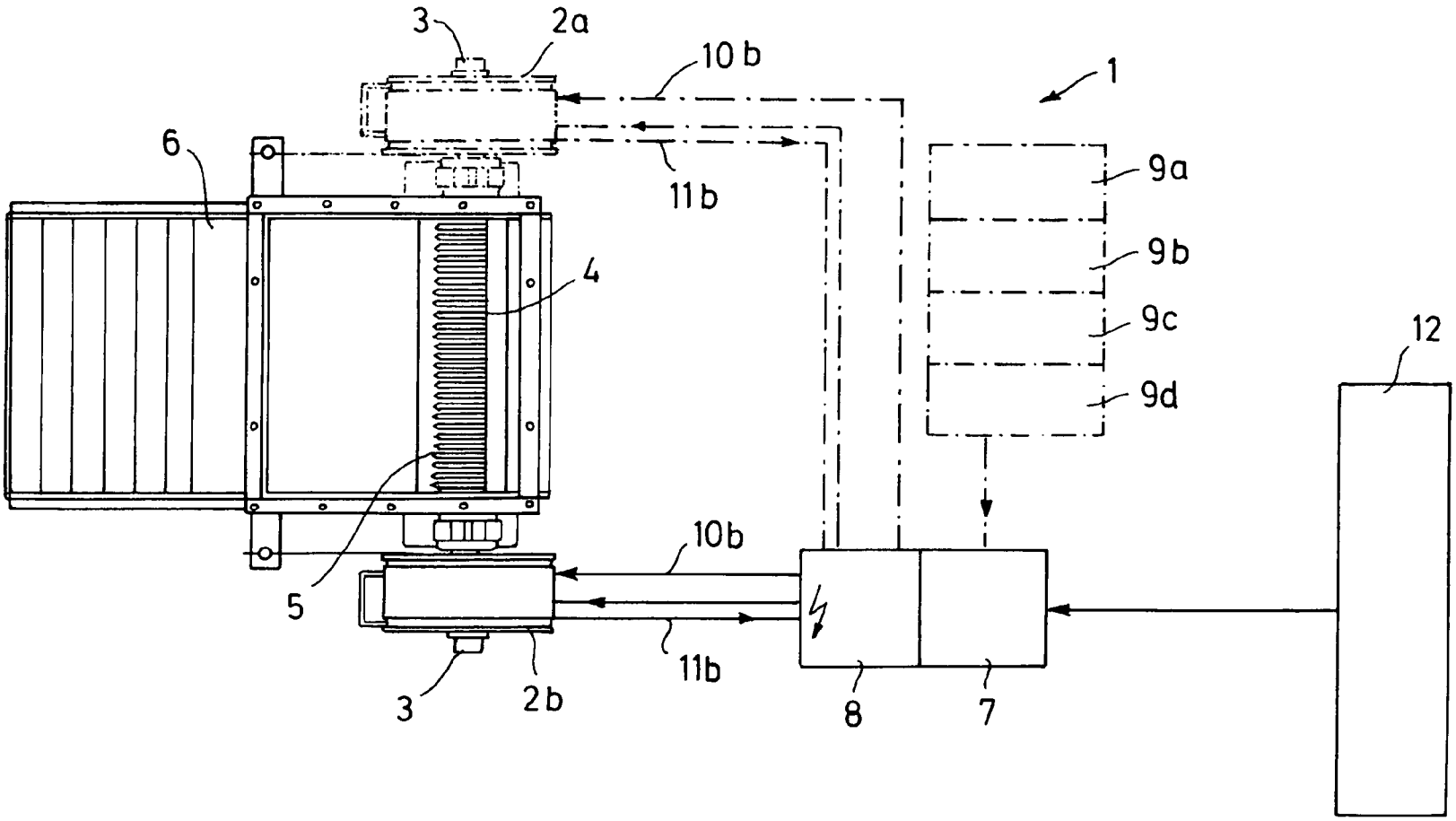
12
9a
9b
9c
9d
1
7
8
10b
11b
10b
11b
2a
4
2b
3
3
5
6

METHOD AND APPARATUS FOR COMMINUTING WASTE

CROSS-REFERENCES TO RELATED APPLICATIONS

This application claims the priority of German patent application Serial No 103 33 359.2 filed Jul. 23, 2003.

FIELD OF THE INVENTION

The invention concerns a comminuting apparatus for waste and/or production residues. The invention further concerns a method of operating a comminuting apparatus.

The term waste will be used hereinafter in this specification in a broad sense to embrace both waste from various processes as well as production residues, as appropriate.

BACKGROUND OF THE INVENTION

A comminuting apparatus may typically be used for example for comminuting wood, paper, plastic material, rubber, textiles, production residues or waste from trade and industry, but also for dealing with bulky refuse, domestic refuse, collections of paper and other waste materials for example from organisations set up to dispose of waste and such like in an environmentally friendly fashion, as well as more specialist waste such as hospital and clinical waste. A comminuting apparatus for such a purpose may comprise a drive unit with at least one electric motor having a drive shaft operatively connected to a comminuting shaft. At its periphery the comminuting shaft has comminuting tools over its working width. The tools co-operate with a counterpart means adapted in respect of shape to the rotational surface of the comminuting shaft, for comminuting the material to be processed. In such an apparatus the material to be comminuted is comminuted by cutting, shearing, squeezing, tearing and/or rubbing, between rotor members or in the co-operation between a rotor member and a fixed transverse member operatively associated therewith. Such an apparatus may be found for example in EP 0 419 919 B1.

There are also forms of comminuting apparatus comprising a plurality of rotors each with a respective stationary transverse member associated therewith, between the respective rotors.

To perform an operation of roughly pre-comminuting waste material, a rotary speed of the comminuting shaft of between about 20 and 50 rpm is appropriate. Hydraulic drives are generally used for that purpose. When dealing with material which is easy to comminute or which is already sufficiently pre-comminuted, such as for example films, sheets, packaging residues and the like, the comminuting apparatus can in principle be operated at higher rotary speeds in order to increase the waste material throughput, and in that respect presentday comminuting apparatuses are equipped with comminuting shafts which may be driven at between about 80 and 500 rpm. The electrical drive power of such an apparatus is between about 30 and 450 kW.

Various drive configurations may be adopted for such comminuting apparatuses. Conventional apparatuses generally include an asynchronous motor which is preferably of a 4-pole configuration and which accordingly operates at a motor speed of 1500 revolutions at a mains frequency of 50 Hz. To set the specified speed of rotation of the comminuting shaft, the transmission of force thereto from the motor is effected by way of a belt drive or a universally jointed shaft or a clutch to a transmission in which the rotary speed, depending on the respective demands involved, is reduced to between about 90 and 200 rpm, whereby the torque at the comminuting shaft is increased in comparison with that of the motor in the same relationship.

In regard to a further design configuration of a comminuting apparatus, it has a drive in the form of an electric motor which is generally of a 4-pole or 6-pole design and which accordingly operates at 1500 rpm or 1000 rpm respectively at a mains frequency of 50 Hz. Connected downstream of the electric motor is a transmission operating with a pulling means such as a belt or chain transmission. That arrangement makes it possible to attain rotary speeds for the comminuting shaft of between about 200 rpm and 500 rpm, by means of a simple drive, although it will be noted that belt pulleys which are very large and usually expensive have to be used.

As the large belt pulleys employed have a high moment of inertia, a load-limiting or load-separating clutch or coupling unit is generally fitted at or in a hub between the comminuting shaft and the belt pulley, preferably a slipping clutch, depending on the material to be comminuted, in order to avoid breakage of the comminuting shaft. At even lower rotary speeds, it is necessary to use a double-run belt transmission. In that case, very high levels of torque can be produced at the comminuting shaft, which however require suitable dimensioning of the drive elements, so that such a design configuration is very expensive and maintenance-intensive, while at the same time the comminuting apparatus takes up a great deal of space, by virtue of its bulky structure. The fluid couplings which are generally used in both the above-discussed drive configurations optimise the known disadvantageous start-up characteristic of an asynchronous motor and make it easier for the comminuting shaft to start under load. In addition, in the event of a sudden blockage, for example due to the presence of a foreign body in the material being comminuted, the coupling arrangement has a damping effect and reduces the load peaks which are produced by the apparatus in the supply mains network.

A further conventional drive arrangement for a comminuting apparatus employs an asynchronous electric motor, a hydraulic pump and an oil motor. The moment produced by that drive assembly is passed to the comminuting shaft with or without an interposed transmission. That design configuration is highly expensive and maintenance-intensive, and comparatively unfavourable in terms of level of efficiency, while in addition the apparatus is very noisy. On the other hand that configuration affords the advantage that the rotary speed of the comminuting shaft can be adjusted over a predetermined range.

What is common to all those conventional drive configurations is that they include a plurality of drive members for connecting a motor to a comminuting shaft. They are comparatively expensive, they increase the amount of space required and in addition increase the level of noise generated by the apparatus. Connecting a plurality of drive members in succession results in the machine suffering from a power loss. In other words, the machine has an unfavourable level of efficiency, with a corresponding energy loss. As the entire drive consists of a plurality of drive members, those drive members in combination exhibit a high level of mass moment of inertia, which, in the event of load peaks which suddenly occur, can result in problems in regard to strength and operating life and under some circumstances can result in parts of the machine being broken and destroyed. Load peaks of that kind can occur on the one hand due to pieces of material which cannot be comminuted, for example metal, stones, rocks and so forth, in the material being processed, but they can also occur when comminuting tough resilient materials with a high level of tearing strength such as for example fiber mesh or web, cables, cords and the like.

Depending on the material being comminuted, the rotor blades adopted and the rotary speed of the rotor or rotors, rotary oscillations often occur, in particular when gear transmissions are used in the drive assembly. Such oscillations generate a large amount of noise and reduce the service life of the drives.

SUMMARY OF THE INVENTION

An object of the present invention is to avoid or at least reduce the problems occurring in a comminuting apparatus of the general kind concerned here.

Another object of the present invention is to provide a comminuting apparatus which can afford greater flexibility of operation in terms of torque production and start-up procedure.

Yet another object of the present invention is to provide a comminuting apparatus for waste with a reduced risk of damage to its drive or comminuting shaft in the event of operational troubles such as blockages.

Still a further object of the present invention is to provide a method of operating a comminuting apparatus which involves flexible and readily adaptable operation thereof.

In accordance with the principles of the present invention in regard to the apparatus a comminuting apparatus for waste comprises a drive unit with at least one electric motor having a drive shaft operatively connected to a comminuting shaft which at its periphery over its working width has comminuting tools. The comminuting tools co-operate with a counterpart means adapted in respect of shape to the rotational surface of the comminuting shaft, for comminuting the material to be processed. The at least one electric motor is in the form of a between 12 and 32-pole three-phase synchronous motor for operation at a rotary speed of between 1 and 500 rpm, which is electrically connected to the output of a frequency converter controlled by a control device. The drive shaft is connected without a transmission directly to the comminuting shaft and the apparatus is devoid of any torque- and/or force-transmitting drive element which in operation rotates faster than the drive shaft.

In terms of the method of the invention the foregoing and other objects are attained by a method of operating a comminuting apparatus wherein, in a start-up operational phase, starting from a stopped condition, the rotary speed of the synchronous motor is regulated to a predetermined reference rotary speed, using a predetermined load current limit, with a substantially constant motor torque. In response to detection of a threat of locking of the drive shaft, the drive is controlled in the reverse mode, whereupon after detection of a reverse rotary movement of the drive shaft the drive shaft, over a predetermined period of time or number of revolutions at the load current limit, is moved in reverse and subsequently is moved forwards again.

As will be seen from the description hereinafter of a preferred embodiment of the apparatus according to the invention, the invention is based on the notion of coupling a rotary speed-variable synchronous motor directly, that is to say without a transmission arrangement in interposed relationship, to a comminuting shaft in order thereby to afford a comminuting machine enjoying entirely new properties. While retaining a maximum torque, in a mode of responding to operating conditions, the rotary speed can be suitably adapted or the torque can also be adjusted in response to operating conditions. The avoidance of a transmission, and therewith the avoidance of a high level of torque inherent in the drive arrangement by virtue of the transmission which would otherwise be present, means that the drive can be operated very flexibly and in particular can be very rapidly set to altered operating conditions. That is advantageous in particular in critical situations when for example there is a threat of blockage.

For the sake of completeness it should be noted at this juncture that in this specification the term 'transmission' is used to denote a mechanical arrangement in which movable components convert input movements into output movements which are different in respect of force, moment, power, speed and/or number of revolutions. In comparison the term 'coupling' is used to denote a pure connection of machine components, in this case the drive shaft of the electric motor and the comminuting shaft, being an arrangement in which the above-indicated parameters remain unchanged. By way of example in this respect reference may be made to a shaft coupling for the transmission of torque between shafts, in the present case for example the drive shaft of the electric motor and the comminuting shaft, wherein such a coupling connection may be rigid or elastic. In accordance with the invention the electric motor and the comminuting shaft are connected together by way of such a coupling.

In accordance with a preferred feature of the invention the apparatus may have a shaft coupling between the drive shaft and the comminuting shaft, for transmitting the torque between the two shafts, thereby affording a particularly advantageous form of connection between the shafts.

In another preferred feature the apparatus has a rigid shaft-hub connection between the drive shaft and the comminuting shaft. The coupling can be of such a configuration that the two shafts are rigidly connected together with a fixing means.

In order to reduce the structural length when the two shafts are arranged with their axes parallel, a preferred feature can also provide that the drive shaft is in the form of a hollow shaft into which the comminuting shaft can be fitted. By virtue of the operation of fitting the comminuting shaft into the hollow shaft, complementarily co-operating means of the two shafts come into engagement to provide a positively locking connection therebetween, in such a way that the comminuting shaft will be appropriately driven by the drive shaft. It is however also possible for the transmission of torque between the hollow shaft constituting the drive shaft of the motor and the comminuting shaft to be afforded by way of a force-locking connection or a combination of force-locking and positively locking connections.

All embodiments involving a connection by way of a hollow shaft and a second shaft of a complementary configuration thereto further have the advantage of ensuring strong axial guidance for the comminuting shaft.

In order to prevent the comminuting shaft from becoming jammed in operation, the comminuting apparatus may have means for detecting the load current and means for detecting the rotary movement of the drive shaft of the synchronous motor, with the control device being connected to the outputs of such means. In that way the control device can be involved immediately when modified operating conditions arise. When for example the comminuting apparatus is in the process of comminuting a foreign body or the like, which under some circumstances may result in an increased level of current draw, that can be detected and motor parameters, for example the rotary speed of the motor, can be adjusted to comply with the modified operating condition. In addition, after the material causing the problem in the apparatus has been processed and after detection of a subsequent reduced level of current draw, the apparatus can be readily set to the preceding reference parameters again. As already explained hereinbefore, the combination of the three-phase synchronous motor which is connected to a frequency converter, with a direct coupling without transmission to the comminuting shaft, can provide that the machine can react very rapidly without any substantial delay to changes in the operating conditions involved, so that in many cases it is possible to avoid locking of the apparatus. However even when such locking occurs the comminuting apparatus according to the invention, by virtue of its low moment of inertia and by virtue of the variability of the rotary speed of the entire drive assembly, enjoys the advantage that the locking of the comminuting shaft can be easily eliminated by the drive shaft being displaced with a shaking or rocking movement, in response to the actual load current and/or the actual rotary position.

In order to be able to process material which may be difficult to comminute or in order to afford an apparatus which has an increased throughput capacity, in accordance with a preferred feature of the invention the counterpart means for the tools on the comminuting shaft may not be afforded by a rigid element, for example a transverse member, but by a further comminuting shaft which is connected to the drive shaft of its own three-phase synchronous motor directly, that is to say without an interposed transmission, wherein the synchronous motor, like the first comminuting shaft, is connected to the output of a frequency converter controlled by the control device. Such an apparatus according to the invention further has the advantage that a comminuting operation can be optimised by virtue of optimised adaptation of the rotary speeds of the two shafts to each other. For example, the two comminuting shafts can be driven in rotation at the same speed, although it is also possible for the rotary speeds to differ. Even in a situation involving locking or a threat of locking of the comminuting shaft during operation of the apparatus, independent actuation and control of the two comminuting shafts affords a high level of flexibility for adapting the apparatus to the respective needs involved.

In order to provide particularly high levels of torque at the comminuting shaft and to load those shafts to the minimum possible extent in regard to torsional forces, in accordance with a further preferred feature of the invention it is provided that two three-phase synchronous motors are associated with an individual comminuting shaft, wherein the drive shafts of the synchronous motors are respectively connected without a transmission directly to the comminuting shaft, as set forth hereinbefore. In this case, the drive shafts can each be coupled to the comminuting shaft at a respective end thereof. It will be appreciated that the two three-phase synchronous motors, for delivering an identical torque, are actuated both at the same rotary speed and in the same phase relationship, for example in a start-up phase.

The principle of the comminuting apparatus according to the invention can also be appropriate for apparatuses with very different electrical drive powers. It is possible in that way to cover the need both in respect of mobile and also static comminuting apparatuses, with electrical drive powers of between 11 and 450 kW.

As has been noted above, the above-outlined comminuting apparatus according to the invention can be operated in such a way that, in a start-up phase of operation, starting from the stopped condition, the rotary speed of the synchronous motor is regulated to a predetermined reference rotary speed, using a predetermined load current limit, with a substantially constant motor torque. In response to detection of a threat of stoppage of the drive shaft, for example by the detection of a rise in the load current, the drive is controlled in the reverse mode. Thereupon, after detection of a reverse movement of the drive shaft, the drive shaft, over a predetermined period of time or until the attainment of the set number of reverse revolutions, at the load current limit, is moved in reverse and is subsequently moved forwards again. The described procedure, by virtue of the reduced moment of inertia of the drive, can be initiated immediately after detection of an increased load current, thereby effectively reducing or eliminating the risk of the comminuting shaft becoming locked.

In order not to overload the motor, it can be provided that, after a predetermined load current limit is exceeded, the rotary speed of the shaft is reduced and, after the termination of the overload phase, the speed of rotation of the motor is regulated to a reference value again.

In principle, for certain operating conditions, predetermined operating procedures can be provided for control of the motor in order on the one hand to ensure that the comminuting shaft is not jammed and on the other hand the motor is not overloaded. Particularly when using the comminuting apparatus according to the invention in a process chain, it may be necessary to regulate the throughput, for example to keep it at a constant value. For that purpose, a detection parameter concerning the material to be comminuted such as weight, volume or moisture content can be detected with a suitable device and can be used to control or regulate the rotary speed of the synchronous motor.

Further objects, features and advantages of the invention will be apparent from the description hereinafter of a preferred embodiment thereof.

BRIEF DESCRIPTION OF THE DRAWING

FIG. 1 is a diagrammatic view showing a comminuting apparatus by way of example in accordance with the invention.

DESCRIPTION OF THE PREFERRED EMBODIMENT

Referring to FIG. 1 of the accompanying drawing, shown therein is a comminuting apparatus 1 according to the invention for waste and/or production residues. The apparatus 1 has an individual comminuting shaft 3 on which comminuting tools 4 are mounted, over a predetermined working region, for example its entire working width. A respective torque motor 2*a*, 2*b* is mounted at each of the two ends of the comminuting shaft 3. It will be appreciated that it is possible for just one motor to be connected to the shaft 3, for example at one end thereof. The synchronous motors 2*a*, 2*b* have drive shafts (not specifically identified here) which are each in the form of a hollow shaft and which are fitted together with the rest of the respective motor on to the comminuting shaft 3 at the ends thereof. The comminuting shaft 3 and the drive shafts of the two motors 2*a*, 2*b* are each rigidly secured to each other by way of a suitable coupling such as a shaft-hub connection.

Reference 5 denotes a counterpart means such as a blade co-operable with the comminuting tools on the comminuting shaft 3, being adapted in shape to the rotational surface or envelope of the comminuting shaft 3 to comminute the waste therebetween.

The two torque motors 2*a*, 2*b* in this embodiment are each in the form of a 32-pole three-phase synchronous motor although they may generally have between 12 and 32 poles according to respective conditions and requirements. They are connected to a frequency converter 8 controlled by a control device 7 illustrated as an stored-program control unit (SPC). Rotary sensors are integrated into the motors and communicate items of information specifying the rotary state of each of the motors and thus the rotary state of the comminuting shaft to the frequency converter 8 and the control device 7 respectively. While the power supply is implemented by way of associated power supply lines 10*a*, 10*b* respectively between a mains connection 12 and the apparatus, the data reproducing the operating state of each respective motor or the requirements thereof are communicated from the frequency converter 8 to the motors by way of associated data lines 11*a* and 11*b* respectively. The control system, by way of associated input lines, receives items of information from a weighing device 9*a*, a volume measurement device 9*b* and a moisture content sensor 9*c*, about the condition of the material to be comminuted, which is currently being processed. Also connected to the control system is an input device 9*d* by way of which a user can preset user-specific operating parameters.

Both motors are in the form of three-phase brushless synchronous motors with permanent magnet excitation. The frequency converter 8 operates in conventional manner insofar as it produces direct current from the three-phase alternating current from the mains connection 12 by means of a rectifier bridge and then converts that direct current by means of an inverter into a three-phase alternating current of variable frequency and voltage, with which the two motors 2*a* and 2*b* are fed.

As the mode of operation of the frequency converter as outlined hereinbefore is known it will not be discussed in greater detail hereinafter. The only essential consideration in this respect is that the control device 7 actuates the frequency converter 8 for setting a given output voltage, an associated output current and/or frequency and the frequency converter performs the commands. As the motors are for example of a 32-pole configuration, they are actuated at the mains frequency for setting a rotary speed of 187.5 rpm. The two motors 2*a* and 2*b* are set up with the frequency converter for operation at a rotary speed of between 0 and 500 rpm.

As shown in the drawing the material being comminuted is fed by way of a transport plate 6 to the comminuting shaft 3 with the comminuting tools 4 mounted thereon.

It will be appreciated that the direct connection of the drive shaft of the at least one motor 2*a*, 2*b* to the comminuting shaft 3 means that no torque-transmitting and/or force-transmitting drive element of the drive assembly rotates faster than the drive shaft.

Operation of the apparatus shown in FIG. 1 will now be described in some greater detail. The maximum current consumption and therewith the maximum torque as well as the rotary speed and thus the throughput of the comminuting apparatus can be suitably adjusted by way of the input device 9*c*. After the start, one or both motors is or are accelerated with the maximum current to the selected rotary speed thereof. Unlike load-free start-up, the start-up phase when starting up under load lasts for a longer period of time as it is not just the comminuting shaft with the comminuting tools mounted thereto and the drive shaft that have to be accelerated up to speed, but at the same time also the material in the apparatus has to be comminuted in the start-up phase. In this case also the apparatus is started up from the rest condition until it reaches the nominal rotary speed at the maximum current, that is to say maximum torque. If however that nominal torque is not sufficient to drive the comminuting shaft when starting up the motor, the control system detects that, on the basis of the signal from the rotary sensor. In response to such detection of a blockage, the motor is actuated to perform a reverse rotary movement by the control device, by way of the frequency converter 8. When in that phase the control system detects a rotational movement of the motor, the reverse movement is maintained over a predetermined period of time or number of revolutions, and the apparatus is then switched into the forward direction again. If no reverse movement is detected by way of the rotary sensor, the apparatus is switched into the forward direction again without any time delay, and that recurring procedure is effected at very short time intervals so frequently as to produce a rotational oscillating effect or rocking motion, whereby the rotor constituted by the comminuting shaft is caused to run virtually in all blocked conditions due to operation of the apparatus. In the case of conventional drives, the high moments of inertia thereof mean that it is scarcely possible, or it is possible only to a very limited degree, to produce such a rocking movement and thus free the comminuting shaft. The small rotating masses of the drive components in the comminuting apparatus in accordance with the present invention mean that such reversals in the direction of movement of the shaft however can be very quickly effected and as a result are particularly effective.

The above-described reversing mode of operation is also employed to advantage in the comminuting apparatus according to the invention if, in normal operation, the moment of inertia of the entire drive assembly and the torque of the motor are not sufficient to comminute for example tough resilient substances, and as a result the rotor including the comminuting shaft comes to a halt. Generally, reversing the motor in the above-indicated manner means that fibers which are wound around the comminuting shaft 3 and fibers which may be jammed between the rotor or comminuting shaft 3 and the stationary counterpart blade 5 co-operating with the comminuting shaft are released.

The above-described comminuting apparatus according to the invention can be actuated in a normal phase of operation for maintaining a predetermined reference rotary speed for both motors 2*a*, 2*b*, that is to say to maintain a constant material throughput rate, as the throughput capacity is in a substantially linear relationship with the speed of rotation of the comminuting shaft 3. That constant condition is maintained as long as the predetermined load current limit is not exceeded. If the material to be comminuted is a tough resilient material, such as for example cords, nets or meshes or textiles, it can happen that higher levels of torque are temporarily required, than the set maximum current consumption permits. In that case, in accordance with the invention, the control system regulates the frequency converter 8 to reduce the rotary speed, while maintaining the maximum current value. The kinetic energy of the comminuting shaft 3 with the tools mounted thereto as well as the drive shaft of the motors and the motor torque which is established by the maximum current is utilised for comminuting the tough material. After the comminuting shaft is liberated to rotate, which can be established by the control device 7 by means of the detected current consumption, it controls the system again to adopt the nominal rotary speed, that is to say a predetermined throughput capacity.

It is also possible, with the comminuting apparatus according to the invention as described hereinbefore, to permanently set the throughput rate of the comminuting apparatus to the respective requirements involved, by constant rotary speed adaptation. That is desirable in particular when the comminuting apparatus is used in a process chain as the control device 7 can adapt the throughput without time delay to the preceding and/or subsequent steps in the process chain.

Depending on the respective needs involved, the comminuting apparatus according to the invention can also be set to a constant throughput, independently of certain properties of the material to be comminuted. Appropriate throughput-governing parameters can be for example mass, volume or moisture content. The speed of rotation of the synchronous motors 2*a*, 2*b* may be regulated either by way of a hand-adjustable potentiometer or by way of an automatic rotary speed control system, by way of the frequency converter 8. The throughput of the machine is dependent on mostly constantly fluctuating input, the moisture content of the material and the respective condition of each of the comminuting shaft tools.

As will be apparent from the description hereinbefore of the preferred embodiment of the comminuting apparatus according to the invention, it can have some major advantages over conventional apparatuses. The use of a between 12-pole and 32-pole three-phase synchronous motor 2*a*, 2*b* in conjunction with a frequency converter 8 connected upstream thereof means that it is possible to afford the maximum torque on the apparatus over the entire rotary speed range, whereby for example the start-up phase is made easier or the apparatus can be started up even under load. The possibility of adjusting the rotary speed flexibly and according to the respective operating phase involved means that it is also possible to eliminate any transmission in the above-defined sense between the motor and the comminuting shaft 3, so that a large part of the moment of inertia of the drive unit, which is otherwise usually to be found in such an apparatus, is eliminated. That can at least reduce the risk of damage in the drive itself or to the comminuting shaft 3 in the event of an abrupt blockage of the shaft 3, for example caused by a foreign body in the material being comminuted. In that way it is possible to eliminate conventional safety and protective measures such as slipping clutches, load-shift clutches or shear-pin couplings. If the material to be comminuted contains large solid uncomminutable substances, massive blows and impacts can be transmitted in conventional comminuting apparatuses to the entire drive system and the housing of the apparatus. In such a situation the flywheel mass of such conventional drives has a very detrimental effect. In the comminuting apparatus according to the invention such impacts are fully damped, in the magnetic field of the synchronous motor, and in that way do not reach the drive housing. The small number of machine components means that the overall efficiency of the drive is highly advantageous, thereby making it possible to save energy. The drive of the comminuting apparatus according to the invention is comparatively light and almost maintenance-free, by virtue of the small number of components therein. As the transmission of force in the synchronous motor takes place in an almost contact-less manner and the main drive motor only runs as fast as the comminuting shaft itself, that drive runs almost silently. The direct coupling of the synchronous motor 2*a*, 2*b* to the comminuting shaft 3 affords a very compact apparatus which in addition is of low weight in comparison with the conventional apparatuses. In that respect the comminuting apparatus according to the invention is also suitable for mobile units. The combination of the synchronous motor 2*a*, 2*b* and the direct coupling of the drive to the comminuting shaft 3 further makes it possible, by virtue of the comparatively low level of inertia of the drive unit and the possibility of easily altering the rotary speed and/or torque, of reacting very quickly to modified operating conditions and setting the drive to the modified conditions.

It will be appreciated that the above-described embodiment has been set forth solely by way of illustration and example of the present invention and that various other alterations and modifications may be made therein without departing from the spirit and scope of the invention.

What is claimed is:

1. A comminuting apparatus for waste comprising a drive unit including at least one electric motor having a drive shaft, the electric motor comprising a three-phase synchronous motor, a comminuting shaft having at the periphery thereof comminuting tool means over a working width thereof, a counterpart means co-operable with the comminuting tool means and adapted in respect of shape to the rotational surface of the comminuting shaft for comminution of the waste material to be processed, means connecting the drive shaft of the electric motor without a transmission directly to the comminuting shaft, a frequency converter having an output, means electrically connecting the electric motor to the output of the frequency converter, and a control device connected to the frequency converter for controlling same, the arrangement being such that no drive element operable to transmit at least one of torque and force is rotatable in operation faster than the drive shaft of the electric motor.

2. A comminuting apparatus as set forth in claim 1 including a shaft coupling between the drive shaft and the comminuting shaft.

3. A comminuting apparatus as set forth in claim 2 including a rigid shaft-hub connection between the drive shaft and the comminuting shaft.

4. A comminuting apparatus as set forth in claim 1 wherein the drive shaft and the comminuting shaft are arranged in axis-parallel relationship.

5. A comminuting apparatus as set forth in claim 4 wherein the drive shaft is in the form of a hollow shaft into which the comminuting shaft is be fitted.

6. A comminuting apparatus as set forth in claim 1 including means for detecting the motor load current and having an output, means for detecting a rotary movement of the drive shaft of the motor and having an output, means connecting the control device to the output of the load detecting means and the output of the rotary movement detecting means, the arrangement being such that when the comminuting shaft is locked the control device actuates the frequency converter for reciprocating movement of the drive shaft in response to one of the actual load current and the actual rotational position of the drive shaft in such a way that the locked comminuting shaft is displaced in a rocking movement.

7. A comminuting apparatus as set forth in claim 1 wherein the counterpart means is a second comminuting shaft, and further including a further three-phase synchronous motor having a drive shaft, means connecting the further drive motor without a transmission directly to the second comminuting shaft, and means electrically connecting said further three-phase synchronous motor to the output of the frequency converter controlled by the control device.

8. A comminuting apparatus as set forth in claim 7 wherein said means connecting the further drive motor to the second comminuting shaft includes a coupling.

9. A comminuting apparatus as set forth in claim 1 including two said three-phase synchronous motors each having a drive shaft, and means connecting the drive shafts directly to the comminuting shaft at respective ones of the ends of the comminuting shaft.

10. A comminuting apparatus as set forth in claim 1 wherein the synchronous motor has an electrical drive power of 11–450 KW.

11. A method of operating a comminuting apparatus as set forth in claim 1 wherein in a start-up operational phase starting from the stopped condition the rotary speed of the synchronous motor is regulated to a predetermined reference rotary speed, using a predetermined load current limit with a substantially constant motor torque, wherein in response to the detection of a threat of locking of the drive shaft the drive is controlled in the reverse mode, whereupon after detection of a reverse rotary movement of the drive shaft the drive shaft over a predetermined period of time or rotary speed at the load current limit is moved in reverse and subsequently is moved forwards again.

12. A method as set forth in claim 11 wherein in a normal operational phase the frequency converter is actuated by the control device for maintaining a predetermined reference motor rotary speed of the associated synchronous motor while maintaining the predetermined load current limit, and wherein after the load current limit is exceeded the rotary speed is reduced and after termination of the overload operational phase the motor rotary speed is regulated to the reference value again.

13. A method as set forth in claim 12 wherein in the normal operational phase in response to detection of a threat of locking of the drive shaft the drive is switched into the reverse mode, whereupon after detection of a reverse rotary movement of the drive shaft the drive shaft over a predetermined period of time or until the set reversing rotary speed is reached at the load current limit is moved in reverse and is subsequently moved forwards again.

14. A method as set forth in claim 11 wherein after detection of a stopped condition in the reverse rotary movement of the drive shaft the drive shaft is immediately actuated again for forward rotary movement.

15. A method as set forth in claim 13 wherein after detection of a stopped condition in the reverse rotary movement of the drive shaft the drive shaft is immediately actuated again for forward rotary movement.

16. A method as set forth in claim 11 wherein the direction of rotation of the drive shaft is switched over a plurality of times so that using the rotational energy of the comminuting shaft and the torque of the at least one synchronous motor the comminuting shaft is caused to rock to be released again.

17. A method as set forth in claim 11 wherein over the entire rotary speed range of the at least one synchronous motor an advance device associated with the motor is controlled in dependence on the current consumption of the synchronous motor.

18. A method as set forth in claim 11 including detecting at least one detection parameter including at least one of weight, volume and moisture content of the waste material to be processed, wherein to keep constant a through-put value including at least one of volume, moisture content and mass of the waste material to be processed the rotary speed of the synchronous motor is regulated in dependence on said detection parameter.

19. A comminuting apparatus for waste comprising a drive unit with at least one electric motor having a drive shaft, a comminuting shaft carrying comminuting tool means, and a counterpart means adapted in respect of its shape to the rotational envelope of the comminuting shaft tool means for co-operation with the comminuting tool means for comminution of the waste material, wherein the electric motor is in the form of a between 12 and 32-pole three-phase synchronous motor for operation at a rotary speed of between 1 and 500 rpm, there is provided a controllable frequency converter having an output electrically connected to the electric motor, and the drive shaft is connected directly without an interposed transmission to the comminuting shaft, whereby the apparatus is devoid of any torque and/or force-transmitting drive element which in operation rotates faster than the drive shaft.

* * * * *